US011353238B2

(12) United States Patent
Fridlyand et al.

(10) Patent No.: US 11,353,238 B2
(45) Date of Patent: Jun. 7, 2022

(54) ULTRASONIC CONDENSATE NEUTRALIZATION AND DISPOSAL SYSTEM

(71) Applicant: GAS TECHNOLOGY INSTITUTE, Des Plaines, IL (US)

(72) Inventors: Aleksandr Fridlyand, Chicago, IL (US); Daniel Suchorabski, Chicago Ridge, IL (US); Paul Glanville, Chicago, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 130 days.

(21) Appl. No.: 16/577,532

(22) Filed: Sep. 20, 2019

(65) Prior Publication Data

US 2020/0096227 A1 Mar. 26, 2020

Related U.S. Application Data

(60) Provisional application No. 62/734,385, filed on Sep. 21, 2018.

(51) Int. Cl.
*F24F 6/12* (2006.01)
*F24F 13/22* (2006.01)

(52) U.S. Cl.
CPC ..... *F24F 13/222* (2013.01); *F24F 6/12* (2013.01); *F24F 2013/225* (2013.01); *F24F 2013/228* (2013.01)

(58) Field of Classification Search
CPC ..... F24F 13/222; F24F 2013/225; F24F 2013/228; F24F 6/12
See application file for complete search history.

(56) References Cited

U.S. PATENT DOCUMENTS 2,838,449 A * 6/1958 Briggs ..... B01J 39/02 210/665
4,067,206 A * 1/1978 Smith ..... F24F 13/224 261/84

(Continued)

FOREIGN PATENT DOCUMENTS

CN 2549364 Y 5/2003
CN 201522038 U 7/2010

(Continued)

OTHER PUBLICATIONS

U.S. Patent Office, English language version of the International Search Report, Form PCT/ISA/210 for International Application PCT/US2019/052205, dated Nov. 25, 2019 (2 pages).

(Continued)

*Primary Examiner* — Filip Zec
(74) *Attorney, Agent, or Firm* — Pauley Erickson & Swanson

(57) ABSTRACT

A system and method for the treatment and disposal of condensate, particularly acidic combustion condensate, are provided. A neutralizer connected with respect to a condensate flow can be used to treat the condensate flow to provide a supply of neutralized condensate to a transfer chamber. Neutralized condensate can be conveyed from the transfer chamber to an ultrasonic atomizer such as via capillary action by way of a wicking assembly. The ultrasonic atomizer is used to produce an atomized neutralized condensate that can be directly discharged or released at a controlled rate, decoupled from condensate generation, and appropriately disposed or utilized (e.g., humidification).

20 Claims, 4 Drawing Sheets

(56) References Cited

U.S. PATENT DOCUMENTS

| | | | | |
|---|---|---|---|---|
| 4,209,335 | A * | 6/1980 | Katayama | C04B 28/02 588/252 |
| 4,289,730 | A | 9/1981 | Tomlinson | |
| 4,317,804 | A * | 3/1982 | Ichijo | C01G 49/0009 423/139 |
| 4,418,961 | A * | 12/1983 | Strom | E21B 43/28 299/4 |
| 4,543,892 | A | 10/1985 | Tomlinson et al. | |
| 4,729,328 | A | 3/1988 | Shellenberger | |
| 5,037,286 | A * | 8/1991 | Roberts | B01J 2/12 425/222 |
| 6,745,590 | B1 | 6/2004 | Johnson et al. | |
| 9,352,993 | B2 * | 5/2016 | Nakajima | F22B 35/10 |
| 10,207,807 | B2 * | 2/2019 | Moran | B64D 13/08 |
| 2011/0259980 | A1 * | 10/2011 | Akisada | B05B 5/0255 239/690 |
| 2015/0083820 | A1 * | 3/2015 | Kawano | A61L 9/14 239/102.2 |
| 2015/0369518 | A1 | 12/2015 | Dresner et al. | |
| 2018/0094825 | A1 | 4/2018 | Peczalski et al. | |
| 2018/0312418 | A1 * | 11/2018 | Martin | F24F 13/222 |

FOREIGN PATENT DOCUMENTS

| | | | |
|---|---|---|---|
| EP | 0 396 294 | A1 | 11/1990 |
| EP | 1 734 316 | A2 | 12/2006 |
| GB | 2 231 401 | A | 11/1990 |
| GB | 2528787 | A | 2/2016 |
| JP | 2006-234271 | A | 9/2006 |
| WO | WO 2016/088022 | A1 | 6/2016 |

OTHER PUBLICATIONS

U.S. Patent Office, English language version of the Written Opinion of the International Searching Authority, Form PCT/ISA/237 for International Application PCT/US2019/052205, dated Nov. 25, 2019 (7 pages).

* cited by examiner

ULTRASONIC CONDENSATE NEUTRALIZATION AND DISPOSAL SYSTEM

CROSS REFERENCE TO RELATED APPLICATION

This application claims the benefit of U.S. Provisional patent application Ser. No. 62/734,385, filed on 21 Sep. 2018. This Provisional application is hereby incorporated by reference herein in its entirety and is made a part hereof, including but not limited to those portions which specifically appear hereinafter.

BACKGROUND OF THE INVENTION

Field of the Invention

This invention relates generally to the collection, treatment and disposal of condensate, particularly, acidic condensate such as generated by condensing combustion appliances.

Description of Related Art

The present invention seeks to address a problem of condensing appliance installation in locations where drains are not available and/or are difficult to install. Currently, this issue is addressed by one of two ways. The condensate can be drained (with or without treatment) outdoors (e.g., soil, gravel, etc.), if permitted by local codes. Alternatively, condensate pumps can be used to collect the condensate in a collection sump with the collected liquid condensate subsequently periodically pumped, such as to a drain located elsewhere in the building or on or off the site. In both approaches, if the appliance is outdoors or installed in a semi-conditioned environments, condensate line freezing is a concern in cold climates, sometimes requiring additional hardware and/or processing such as the inclusion of supplemental heating.

Integrated combustion condensate neutralization systems are in the background art. Integrating a combustion condensate neutralizers with an appliance is taught or suggested in references such as U.S. Pat. No. 4,289,730 (Furnace with Flue Gas Condensate Neutralizer) and application JP2006234271A (Combustion device). There are also patents for neutralization systems that connect the appliance to a separate disposal system, with active feedback controls. e.g., GB2528787 (A condensate disposal system for disposing of condensate from condensing fuel burning appliances, a condensing fuel burning appliance having a condensate).

Misting/spraying/evaporating combustion condensate into combustion flue gas exhaust is found in EP0396294B1 (Gas fired appliances and installations incorporating such appliances) and Application JP2006234271A (Combustion device). EP1734316B1 (Condensing boiler assembly) uses a high-pressure pump and a nozzle to spray condensate into the flue-gas exhaust stream, relying on the latter to carry the condensate away. In all these applications, the condensate mist must be mechanically moved out of the system using the flue-gas exhaust stream.

Evaporating combustion condensate into a second air stream for the purposes of space humidification and disposal is found in US 2015/0369518A (High Efficiency Heater With Condensate Collection and Humidification) describes a condensing heater that uses a secondary fan and an ultrasonic atomizer to push condensate mist out of the heater enclosure to humidify indoor air. The patent application WO2016088022A (Condensate Atomising System) describes a standalone device that collects the condensate in an enclosure with an ultrasonic atomizer and uses a fan to push the atomized mist out of the enclosure. Both methods rely on secondary fans to move the condensate mist.

Using ultrasonic atomizers to handle and reuse/dispose of air conditioning (A/C) condensate is found in U.S. Pat. No. 6,745,590 (Condensate Removal System) which is similar to WO2016088022A1 where condensate is collected in an enclosure, atomized using an ultrasonic transducer, and exhausted using a fan or the venturi effect. CN201522038U (Condensate Recovering And Utilizing And Energy-Saving System For Split Air Conditioner) describes a system that collects condensate from a split A/C system and reuses it with an ultrasonic atomizer to improve the efficiency of the outdoor condenser by spraying the condensate mist onto the coils. Grant CN2549364Y (Air-conditioner with condensed water ultrasonic atomizer) describes an application where the ultrasonic atomizer is used to humidify indoor air with the A/C condensate or exhausts it directly outdoors.

SUMMARY OF THE INVENTION

A general object of the subject development is to provide improved treatment and disposal of condensate, particularly acidic condensate such as generated by condensing appliances including but not limited to water heaters, heat pumps, air-conditioners, boilers, furnaces, unit heaters, and rooftop units, for example.

A more specific objective of the subject development is to overcome one or more of the problems described above.

The present invention contemplates a new and improved integrated device or system for collecting, treating, and disposing of acidic condensate generated by condensing combustion appliances such as described or identified above. The device or system can desirably act or serve: 1) to receive combustion condensate through a wetted trap and feeds, via gravity or pump, into a neutralization chamber, 2) as a means of passive level control and system control, including combustion controls, to assure the reception trap is flooded to prevent flow of flue gases through neutralization chamber, may include 3) as a treatment chamber (e.g., acidity neutralization and/or precipitation) such as with an easily removable media insert sized for extended operation with infrequent replacements, and 4) a wicking media transferring assembly such as may serve to transfer treated condensate, such as via capillary action, from a second chamber to an ultrasonic transducer that selectively appropriately discharges, ejects or expels atomized mist such as into (a) a sealed exhaust duct, (b) the cowl of a fan exhausting into a conditioned space, (c) directly into the ambient surroundings, (d) directly outdoors or (e) as may otherwise be desired in a particular or specific application. As will be appreciated by those skilled in the art and guided by the teachings herein provided the practice of the invention in specific applications can handle combinations of acidic and neutral condensate streams, such as condensed water from air-conditioning and heat pump and particular embodiments may be utilized or practiced such as by excluding the condensate neutralizing module when unnecessary, based on design pH of condensate.

In accordance with one aspect of the subject development there is provided an improved device or system having particular applicability for use in conjunction with an appliance that generates condensate. In one embodiment, such a device or system includes an ultrasonic transducer such as in the form of an ultrasonic atomizing transducer that is connected in fluid engagement with a supply of neutralized condensate. The ultrasonic atomizer acts or serves to produce atomized neutralized condensate. The atomized neutralized condensate can be subsequently released or discharged from the device or system such as through an opening or vent. The condensate treatment and disposal system can advantageously include or incorporate a control system to control a rate of release of the atomized neutralized condensate decoupled from condensate generation. Thus, such atomized neutralized condensate can desirably be discharged or released. e.g., directly discharged or released, at a controlled rate, decoupled from condensate generation, and appropriately disposed or utilized (e.g., humidification).

In another embodiment, a system or device for condensate treatment includes a wetted trap through which a condensate flow is introduced. A neutralizer is connected with respect to the condensate flow through the wetted trap. The wetted trap acts or otherwise serves to prevent flow of gas through the neutralizer. The neutralizer treats the condensate flow to neutralize acidity of the condensate and/or remove metals. To that end, the wetted trap may also act or otherwise serve to assure sufficient condensate residence time within the neutralizer. The neutralizer thus provides a supply of neutralized condensate. The system or device further includes a transfer chamber into which the supply of neutralized condensate from the neutralizer is introduced. An ultrasonic atomizer is connected in fluid engagement with the supply of treated condensate from the neutralizer via the transfer chamber. A wicking transfer assembly serves to transfer the supply of neutralized condensate from the transfer chamber to the ultrasonic atomizer via capillary action.

In accordance with another aspect of the subject development there is provided a method for treating and disposing of a condensate such as via a condensate treatment and disposal system such as herein provided. In one embodiment, such a method involves introducing a supply of neutralized condensate to an ultrasonic atomizer to produce an atomized neutralized condensate. The atomized neutralized condensate can and desirably is subsequently expelled from the system such as via a vent or opening.

Advantages of at least particular embodiments of the invention can include that it can be very inexpensive, simpler than prior art, compact, and very flexible. Ultrasonic transducers fit for the purpose have benefited from economies of scales facilitated by the residential humidification market (e.g., cool mist humidifiers). Transducers and all necessary electronics can be purchased relatively cheaply. The balance of the system can be made from inexpensive plastics and neutralizer media.

BRIEF DESCRIPTION OF THE DRAWINGS

Objects and features of this invention will be better understood from the following description taken in conjunction with the drawings, wherein.

DETAILED DESCRIPTION

Figure 1:
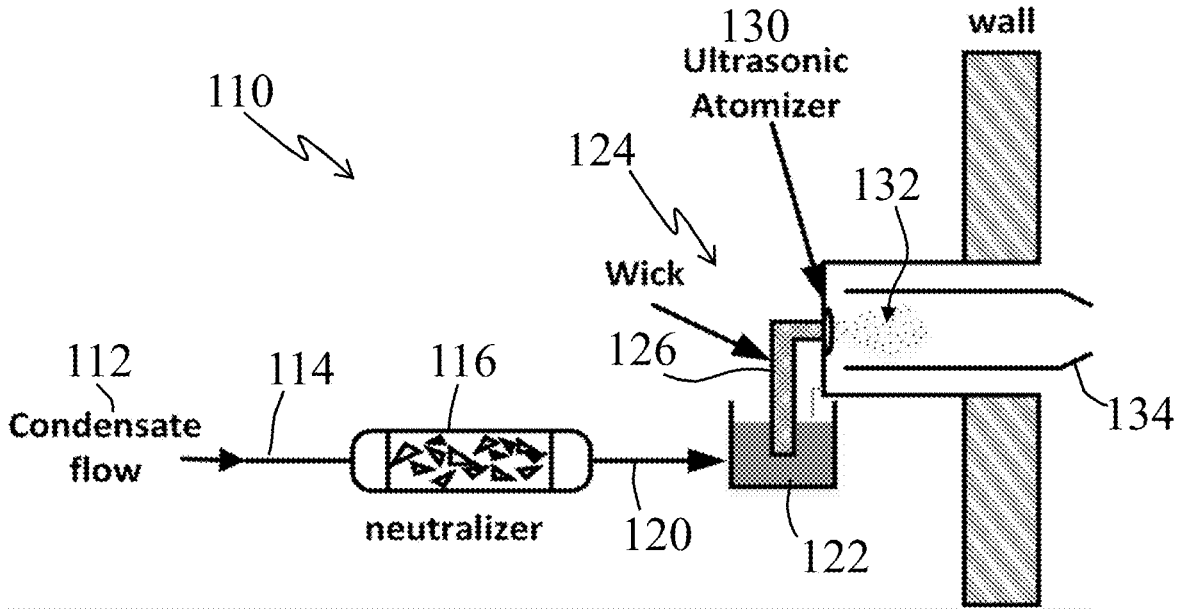
FIG. 1 is a simplified schematic of a wick-fed system in accordance with one embodiment of the invention.
Figure 2:
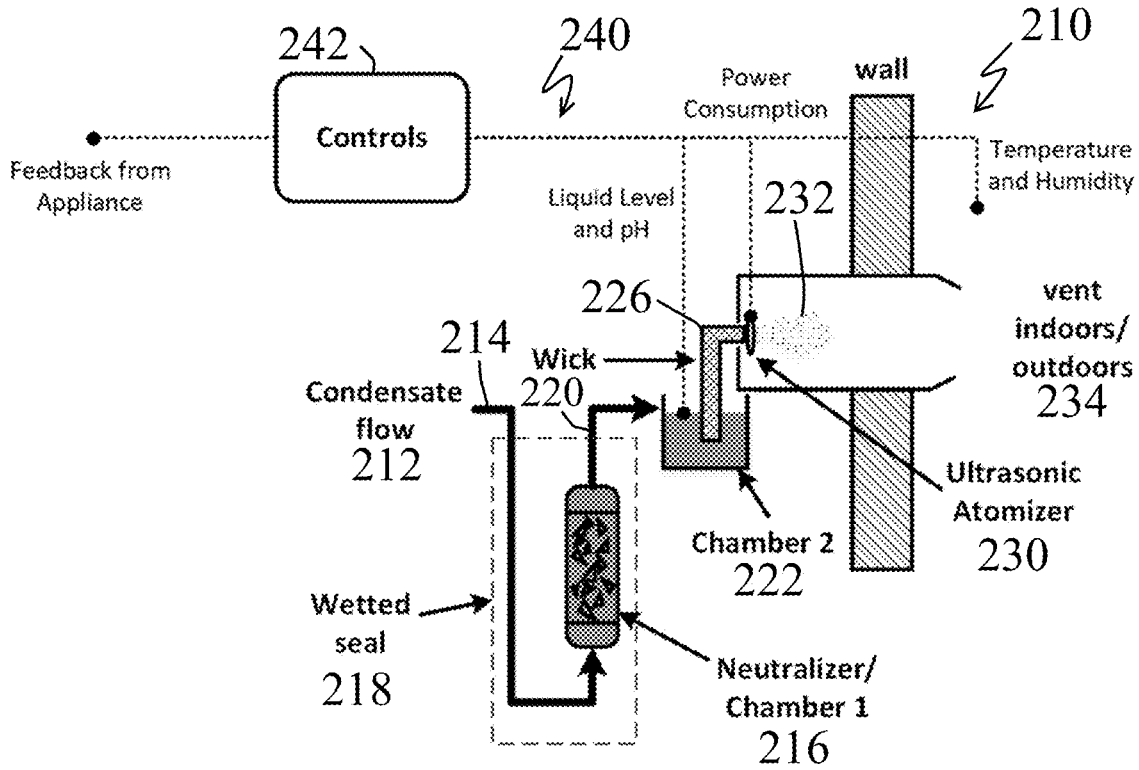
FIG. 2 is a simplified schematic of a wick-fed system in accordance with another embodiment of the invention.
Figure 3A:
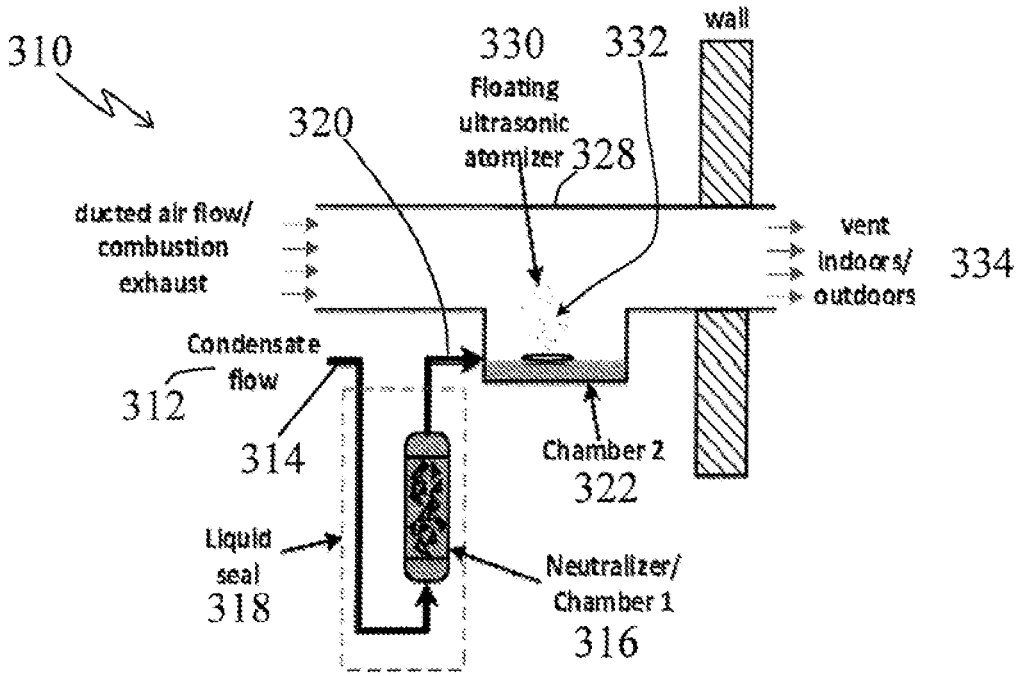
FIG. 3A is a simplified schematic of a floating atomizer system in accordance with another embodiment of the invention.
Figure 3B:
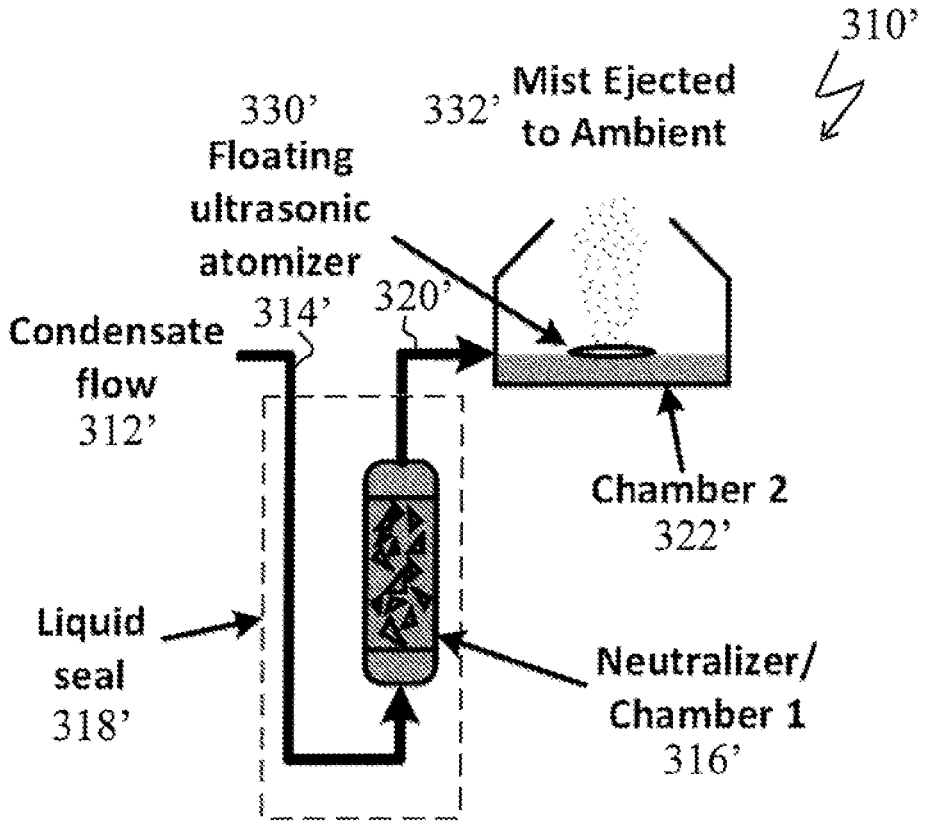
FIG. 3B is a simplified schematic of a floating atomizer system in accordance with yet another embodiment of the invention.
Figure 4:
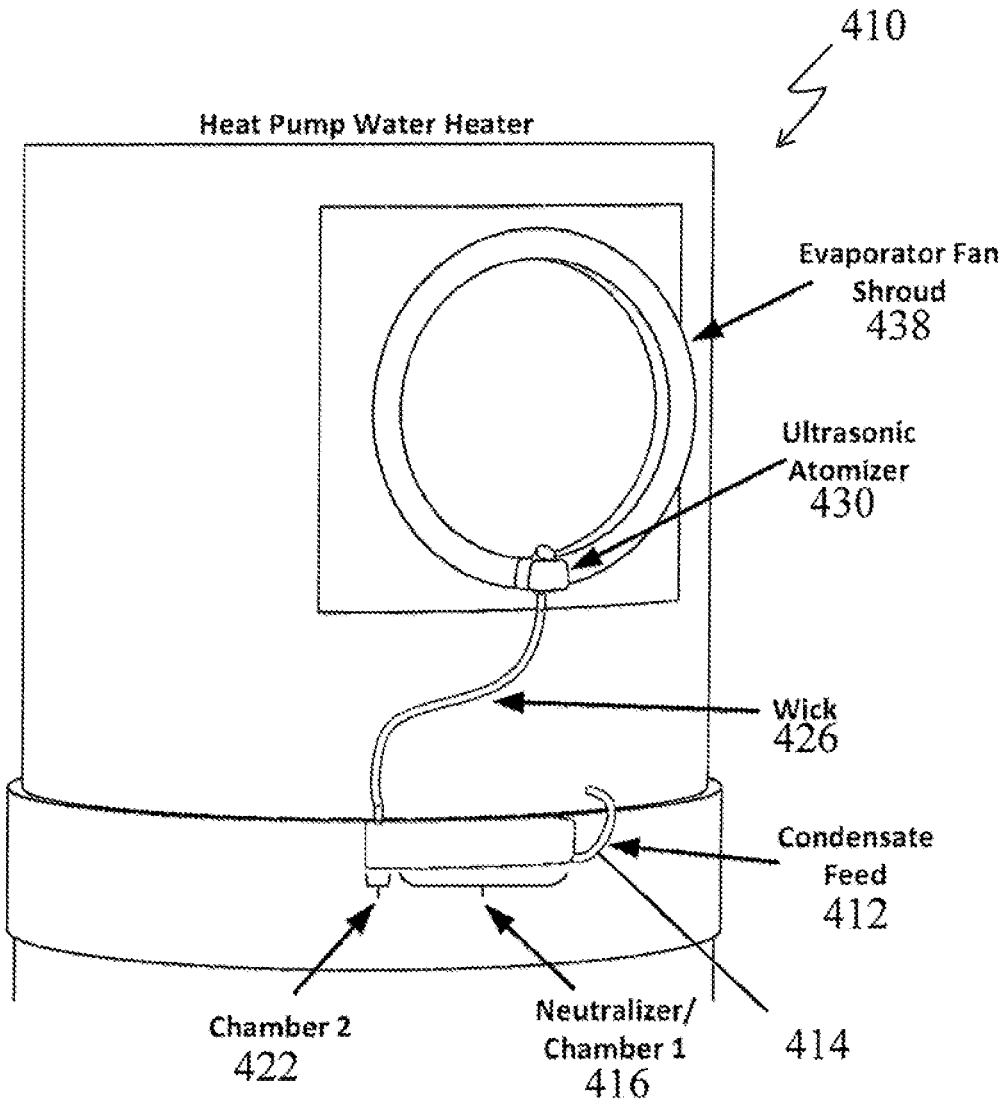
FIG. 4 is a front perspective view of a potential device in accordance with one embodiment of the invention.

FIGS. 1-4 illustrate devices and systems in accordance with various embodiments of the invention. More specifically, FIG. 1 shows a simplified wick-fed condensate treatment and disposal device or system, generally designated by the reference numeral 110, in accordance with one embodiment of the invention. FIG. 2 shows a more specific embodiment of a wick-fed condensate treatment and disposal device or system, similar to the system 110 shown in FIG. 1 and here generally designated by the reference numeral 210. FIG. 3A and FIG. 3B show floating atomizer condensate treatment and disposal devices or systems, generally designated by the reference numerals 310 and 310', respectively, as described in further detail below. FIG. 4 illustrates a condensate treatment and disposal device or system, generally designated by the reference numeral 410, in accordance with one embodiment.

The proposed device addresses the collection, treatment, and disposal of acidic condensate, such as when the condensate is partially or wholly generated by high-efficiency combustion and/or refrigeration/HVAC device. In accordance with a preferred embodiment, the invention desirably accomplishes one or more and preferably each of the following goals, including: (1) integrating condensate handling with a high-efficiency combustion and/or refrigeration/HVAC device simplifies and reduces the installed cost of said equipment; (2) through integrated handling and disposal, the need for additional condensate pumps and means of drainage can be avoided; and (3) where permissible and useful, treated, atomized condensate can offer added value through humidification or evaporative cooling.

In the wick-fed combustion condensate treatment and disposal device or system 110 shown in FIG. 1, a combustion condensate flow 112 is introduced through a line 114 into a treatment chamber, or sometimes referred to as a neutralizer or first chamber, 116. Resulting neutralized combustion condensate is introduced via a line 120 into a transfer chamber 122, or sometimes referred to as a second chamber. A wicking transfer assembly 124 is provided to transfer neutralized combustion condensate from the transfer chamber 122, such as via capillary action via a wicking media 126 to an ultrasonic atomizer 130. The ultrasonic atomizer 130 desirably serves to eject an atomized mist through a vent 134. As shown, such a vent 134 can extend through a wall or other barrier element such that the atomized mist 132 can be discharged or released into the ambient surroundings, outdoors, into an exhaust duct or in a conditioned space, for example, as may be desired for a particular application.

An integrated device or system such as herein provided, such as the wick-fed condensate treatment and disposal device or system 210 shown in FIG. 2 and the alternative embodiment floating atomizer condensate treatment and disposal device or system 310 shown in FIG. 3A, can be used to collect, treat, and dispose of acidic condensate generated by condensing appliances including but not limited to water heaters, heat pumps, air-conditioners, boilers, furnaces, unit heaters, and rooftop units. The devices or systems 210 and 310, as shown schematically in FIGS. 2 and 3A, respectively, receive a condensate flow 212, 312 through a line 214, 314 into a neutralizer, or sometimes referred to as a first chamber, 216, 316. As shown, the condensate flow 212, 312 into the neutralizer 216, 316 is desirably through a wetted or liquid trap or seal 218, 318, via gravity or a pump (not shown). A passive level control and system control is preferably included with the device and may include controls, to assure that the trap is flooded to prevent flow of flue gases through the neutralization chamber. The neutralizer or treatment chamber 216, 316 (acidity neutralization and/or precipitation), if included, may additionally be provided with or include a removable and replaceable media insert, or the like, such as sized for extended operation with infrequent replacements. Thus, the neutralizer or treatment chamber may suitably include or contain a removable element to recharge at least one of the neutralizer and a filtration media.

Resulting neutralized condensate is introduced via a line 220, 320 into a transfer chamber 222, 322, or sometimes referred to as a second chamber.

In the wick-fed condensate treatment and disposal device or system 210 shown in FIG. 2, similar to the system 110 shown in FIG. 1 and described above, a wicking media 226 preferably transfers treated condensate, via capillary action, from the second chamber 222 to an ultrasonic transducer 230 that discharges, ejects or otherwise emits an atomized mist 232, such as through a vent 234 or ducted air stream.

A key feature at least in accordance with certain preferred embodiments of the invention is an ability to discharge or release neutralized condensate, from a combustion appliance or other source, into an ambient environment or airstream at a controlled rate that is decoupled from the rate of condensate generation. This feature permits the invention to control the accumulation of condensate, to assure a wetted seal where necessary or to evacuate (e.g., dry out) the assembly for freeze protection or servicing. Additionally independent control of neutralized condensate disposal permits utilizing said condensate for an auxiliary purpose, such as evaporative cooling or humidification, which may be independently controlled from the appliance operation for a desired effect.

To that end and as further shown in FIG. 2, the wick-fed condensate treatment and disposal device or system 210 can advantageously include or incorporate a control system or arrangement such as generally designated by the reference numeral 240.

The device controls 242 may be informed by a plurality of sensors to control one or more atomizers to operate at a constant or variable rate, and may include some or all of the following sensors:

1. Power consumption of the atomizer 230, to measure energy consumption and as a means of detecting atomizer dryout to infer the volume of condensate within the second chamber 222.

2. Temperature, liquid level, and/or pH of the condensate, to determine the effectiveness of the neutralizer 216, detect overflow/dryout conditions of the second chamber 222, and detect unsafe operating conditions (e.g. freezing temperatures, ingress of combustion gases). These sensors may also be applied to the neutralizer 216.

3. Temperature and humidity of the air where condensate is atomized (ambient or in-duct) to similarly detect unsafe operating conditions and to control delivered temperature and/or humidity for condensate utilization (humidification or evaporative cooling).

4. Feedback from the condensate-generating appliance to inform the system or device of its operational characteristics, including other auxiliary equipment where applicable (e.g. external duct exhaust fans).

Where necessary, the controls may also operate condensate pumps or air-moving equipment (blowers, exhaust fans) and communicate operational states to the appliance or end user, such as a need to replace the neutralizer or filter pack.

While the inclusion and presence of such a control system or arrangement has been shown only in connection with the wick-fed condensate treatment and disposal device or system 210, it is to be understood and appreciated that such or similar control system or arrangement can be appropriately advantageously applied to the alternative embodiments herein described or provided.

In the floating atomizer condensate treatment and disposal device or system 310 embodiment shown in FIG. 3A, the transfer chamber 322 is shown as a reservoir formed as a part of an air flow/combustion exhaust duct 328. A floating ultrasonic atomizing transducer 330 is situated or otherwise appropriately disposed in the transfer chamber 322 reservoir. To that end, the ultrasonic transducer may be suitably tethered or otherwise appropriately joined or connected in, with or to the transfer chamber. The ultrasonic transducer 330 discharges, ejects or otherwise emits an atomized mist 332 into the air flow/combustion exhaust duct 328 and in turn out through a vent 334. If desired, the ultrasonic transducer can be situated or disposed to discharge, eject or otherwise emit an atomized mist into the ambient, e.g., directly to vent.

FIG. 3B illustrates a floating atomizer system 310' in accordance with another embodiment of the invention. In the floating atomizer condensate treatment and disposal device or system 310', a condensate flow 312' is introduced through a line 314' into a neutralizer, or sometimes referred to as a first chamber, 316'. As shown, the condensate flow 312' into the neutralizer 316' is desirably through a wetted or liquid trap or seal 318', via gravity or a pump (not shown). Resulting neutralized condensate is introduced via a line 320' into a transfer chamber 322' or sometimes referred to as a second chamber. A floating ultrasonic atomizing transducer 330' is situated or otherwise appropriately disposed in the transfer chamber 322'. To that end, the ultrasonic transducer may, as noted above, be suitably tethered or otherwise appropriately joined or connected in, with or to the transfer chamber. The ultrasonic transducer 330' discharges, ejects or otherwise emits an atomized mist 332' into the ambient.

Those skilled in the art and guided by the teaching herein provided will understand and appreciated that devices and systems of the invention as well as methods of the invention can, in their broader application or practice generally be utilized in conjunction with any condensate-producing appliance. Moreover, the devices and systems of the invention as well as methods of the invention can handle combinations of acidic and neutral condensate streams, such as condensed water from air-conditioning and heat pump applications and that embodiments may, for example, exclude the condensate neutralizing module when unnecessary, such as based on design pH of condensate.

A device or system in accordance with embodiments of the invention and installed into, onto, or next to a combustion condensate producing appliance is intended to trap the combustion condensate in an enclosure and prevent outflow of combustion flue gases by using a wetted seal and a two-chamber configuration. Further, in a first chamber of the device, combustion condensate acidity (e.g., acids such as nitric, sulfuric, carbonic acids and combinations thereof) is desirably neutralized and dissolved metal ions (e.g., iron, chromium, copper and combinations thereof) are desirably precipitated out using an appropriate media such as calcium carbonate, for example. In a second chamber of the device, a wicking media transfers the treated condensate from to an ultrasonic mist generator, leaving behind insoluble solids. Preferably, the second chamber only collects liquid when the first chamber exceeds a minimum liquid level in order to maintain the wetted seal. A high limit liquid level sensor is used to stop the appliance operation if the system is flooded. An ultrasonic mist generator is used to release or eject treated and atomized condensate into an exhaust air stream, into the ambient space, or directly outdoors. The atomized condensate in air is readily evaporated, thereby eliminating the need to transfer the liquid condensate to a drain, outdoor soil, or a collection bin.

The treatment chamber, wicking media, and ultrasonic transducers are sized such that the residence time of the combustion condensate in the treatment chamber is long enough to achieve sufficient neutralization (e.g., $5<pH<10$), precipitation of any metals, and to reduce the risk of overflow.

For applications where acidic condensate generated would be at-risk of freezing, high-efficiency rooftop combustion equipment, outdoor gas-fired heat pump equipment, or other devices, the proposed invention could be modified as follows: (1) integrating system into the cabinet of the heating device and insulated to assure receipt and retention of waste heat during equipment on-cycle; (2) wicking and ultrasonic atomization process could be sized to assure evacuation of reservoir after equipment off-cycle and loss of retained waste heat; (3) neutralization step can be eliminated when unnecessary, to limit size of flooded volume.

A preferred embodiment of the invention is a standalone, compact, and flexible combustion condensate treatment and disposal system that does not require any additional fans and/or pumps. The ultrasonic transducer used in a preferred embodiment of the present invention imparts sufficient momentum on the water droplets to allow the mist to move on its own. Prior devices typically rely on secondary fans or existing exhaust streams to move the atomized mist. A preferred embodiment of the inventions consumes little electricity to dispose of the condensate and generates little noise. Further, as no additional fans or heaters are necessary, the excitation of the ultrasonic transducer is all the power that is required compared to prior art devices and systems.

Turning to FIG. 4, there is shown the condensate treatment and disposal device or system 410. In this illustrated embodiment, the system 410 is disposed or used in conjunction with a gas heat pump water heater. In the system 410, similar to the above described systems, a condensate flow 412 is introduced through a line 414 into a neutralizer, or sometimes referred to as a first chamber 416.

A transfer chamber 422, or sometimes referred to as a second chamber, is in fluid flow communication with the neutralizer 416 such as to receive neutralized condensate therefrom. A wicking media 426 preferably transfers treated condensate, via capillary action, from the second chamber 422 to an ultrasonic transducer 430 that discharges, ejects or otherwise emits an atomized mist into an evaporator fan shroud 438.

The flexibility of the system is facilitated by the use of a wicking media to transfer condensate from a collection chamber to the ultrasonic transducer. In this arrangement, the ultrasonic transducer can be installed to discharge, eject or release the condensate directly indoors, outdoors, or into any existing exhaust air duct. The ultrasonic transducer can be installed in any arrangement (horizontal, vertical, down-facing, etc.) and the system will operate as long as the wick remains wetted. Similarly, the wick can be suitably oriented, e.g., vertically, horizontally or in some intermediate or combination, as may be desired in particular applications such as to accommodate different system geometries. Additionally, wick parameters such as material of construction, thickness, cross-section and length, for example, are design variables that can be suitably optimized for particular applications. The system can also operate at the same time as or independent of the appliance, which serves to decouple the condensate disposal from handling and neutralization, which allows for adequate condensate residence time within the neutralizer without requiring substantial neutralized condensate storage. The combination of wicking media and neutralization can serve as two-stage filtration of condensate, if reuse is intended. Additionally, the wicked chamber of a device or system in accordance with the invention can, if desired be intentionally dried out such as during periods of anticipated low activity, maintenance, or as a means of freeze protection.

The integration of the neutralizer, wicking media, and the ultrasonic transducer ensures only treated condensate is ejected into the environment. The two chamber arrangements prevents wetted trap dry out and provides sufficient time for condensate treatment, preventing the ejection of corrosive mists. The use of a wicking media to transfer the condensate prevents insoluble solids from being ejected with the ultrasonic mist. Additionally, with the use of tailored neutralization media, the system can be optimized to the design residence time of condensate, to leverage lower cost media or improve neutralization performance. The advantages of the concept are that it can be very inexpensive, simpler than prior art, compact, and very flexible. Ultrasonic transducers fit for the purpose have benefited from economies of scales facilitated by the residential humidification market (e.g., cool mist humidifiers). Transducers and all necessary electronics are relatively inexpensive. The balance of the system can be made from inexpensive plastics and neutralizer media.

The concept was specifically conceived for a small-scale gas-fired heat pump device intended for installation indoors. The present invention can potentially eliminate a significant barrier to the broader adoption of this technology, i.e., the lack of a nearby drain. At the same time, the invention can be readily adapted for use with other condensing combustion appliances, including furnaces, boilers, unit heaters, and commercial rooftop units and accommodate devices with multiple condensate streams, such as those generating acidic and neutral condensate streams simultaneously. The system can be integrated with the appliance or be installed as a processing add-on, such as to a current or previously existing assembly or device.

Although a combination of features is shown in the illustrated examples, not all of such features need to be combined to realize all the benefits associated with particular embodiments of the invention. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

Furthermore, it is to be understood that the invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A condensate treatment and disposal system for use in conjunction with an appliance that generates condensate, the system comprising:

a condensing appliance with a collection sump configured to receive an acidic condensate;

a neutralizer connected to a condensate flow line from the collection sump, the neutralizer configured to treat the acidic condensate and provide a supply of neutralized condensate;

an ultrasonic atomizer connected in fluid engagement with the supply of neutralized condensate, the ultrasonic atomizer producing atomized neutralized condensate;

a wicking media connecting the ultrasonic atomizer to the supply of neutralized condensate, the wicking media configured to transfer the supply of neutralized condensate to the ultrasonic atomizer via capillary action;

an opening in the condensing appliance through which the atomized neutralized condensate from the ultrasonic atomizer is directly released from the condensing appliance by the ultrasonic atomizer; and a control system to control a rate of release of the atomized neutralized condensate decoupled from condensate generation.

2. The system of claim 1 wherein the supply of neutralized condensate is of a pH greater than 5 and less than 10.

3. The system of claim 1 additionally comprising:

a transfer chamber into which the supply of neutralized condensate from the neutralizer is introduced, the transfer chamber in fluid flow communication with the ultrasonic atomizer via the wicking media.

4. The system of claim 3 wherein the wicking media connects the transfer chamber to the ultrasonic atomizer, and is configured to transfer the supply of neutralized condensate from the transfer chamber to the ultrasonic atomizer via the capillary action.

5. The system of claim 3 wherein the ultrasonic atomizer is a flat ultrasonic atomizer at least in part disposed in the transfer chamber.

6. The system of claim 1 wherein the neutralizer treats the condensate flow to at least one of neutralize acidity of the condensate and remove metals.

7. The system of claim 6 wherein the neutralizer treats the condensate flow to neutralize acidic components selected from the group consisting of nitric, sulfuric, carbonic and combinations thereof.

8. The system of claim 6 wherein the neutralizer treats the condensate flow to precipitate dissolved metal ions via a precipitating media.

9. The system of claim 8 wherein dissolved metal ions selected from the group consisting of iron, chromium, copper and combinations thereof are precipitated.

10. The system of claim 8 wherein calcium carbonate is the precipitating media.

11. The system of claim 1 additionally comprising a wetted trap through which the condensate flow is introduced into the neutralizer, the wetted trap preventing flow of gas through the neutralizer and assuring sufficient condensate residence time within the neutralizer.

12. An acidic condensate treatment and disposal system, the system comprising:

a condensing appliance with a collection sump configured to receive an acidic condensate, a wetted trap through which a condensate flow of the acidic condensate is introduced, a neutralizer connected with respect to the condensate flow through the wetted trap, the wetted trap preventing flow of gas through the neutralizer, the neutralizer treating the condensate flow to at least one of neutralize acidity of the acidic condensate and remove metals and to provide a supply of neutralized condensate, a transfer chamber into which the supply of neutralized condensate from the neutralizer is introduced, and an ultrasonic atomizer adjacent an opening in a wall of the condensing appliance and connected in fluid engagement with the supply of treated condensate from the neutralizer via the transfer chamber; and a wicking media connecting the ultrasonic atomizer to the transfer chamber, and configured to transfer the supply of neutralized condensate from the transfer chamber to the ultrasonic atomizer via capillary action.

13. The system of claim 12 wherein the neutralizer contains a removable element to recharge at least one of the neutralizer and a filtration media.

14. The system of claim 12 wherein the ultrasonic atomizer is a flat ultrasonic atomizer at least in part disposed in the transfer chamber.

15. A method for treating and disposing a condensate via a condensate treatment and disposal system, the method comprising:

introducing a condensate flow from a condensing appliance into a neutralizer to provide the supply of neutralized condensate;

wicking a supply of neutralized condensate to an ultrasonic atomizer of the system to produce an atomized neutralized condensate; and expelling the atomized neutralized condensate from the system through an opening in a wall of the condensing appliance.

16. The method of claim 15 additionally comprising:

introducing the supply of neutralized condensate from the neutralizer to a transfer chamber, and wicking the supply of neutralized condensate from the transfer chamber to the ultrasonic atomizer via capillary action.

17. The system of claim 1 additionally comprising:

a transfer chamber into which the supply of neutralized condensate from the neutralizer is introduced, the transfer chamber in fluid flow communication with the ultrasonic atomizer, wherein the ultrasonic atomizer is separate from the transfer chamber and connected to the supply of neutralized condensate in the transfer chamber by the wicking media.

18. The system of claim 1, wherein the opening is in a vertical wall of the condensing appliance, and the wicking media comprises a combination of a vertical wick direction and a horizontal wick direction to connect the supply of neutralized condensate to the opening.

19. The system of claim 18, further comprising an evaporator fan shroud or an exhaust air duct adjacent the opening, wherein the ultrasonic atomizer emits the atomized neutralized condensate to the evaporator fan shroud or into the exhaust air duct.

20. The system of claim 1, wherein the condensing appliance is a water heater, and the opening is in an external wall of the water heater, the external wall connected to ambient surroundings or an exhaust duct.

* * * * *